United States Patent [19]

Bögel

[11] Patent Number: 4,782,679

[45] Date of Patent: Nov. 8, 1988

[54] PROCESS FOR THE PRODUCTION OF FLANGES OR COLLARS ON HOLLOW PARTS BY LATERAL EXTRUSION

[75] Inventor: Helmut Bögel, Aalen, Fed. Rep. of Germany

[73] Assignee: Gesenkschmiede Schneider GmbH, Aalen, Fed. Rep. of Germany

[21] Appl. No.: 37,256

[22] PCT Filed: Aug. 14, 1985

[86] PCT No.: PCT/DE85/00276

§ 371 Date: Apr. 8, 1987

§ 102(e) Date: Apr. 8, 1987

[87] PCT Pub. No.: WO87/01991

PCT Pub. Date: Apr. 9, 1987

[51] Int. Cl.[4] ..... B21D 26/02

[52] U.S. Cl. ..... 72/57; 72/370

[58] Field of Search ..... 72/57, 58, 260, 370

[56] References Cited

U.S. PATENT DOCUMENTS

| | | | |
|---|---|---|---|
| 203,842 | 5/1878 | Leland | 72/57 |
| 2,138,199 | 11/1938 | Wendel | 72/58 |
| 2,168,641 | 8/1939 | Arbogast | 72/58 |
| 2,328,742 | 9/1943 | Rogers et al. | 72/370 |
| 3,442,106 | 5/1969 | Gray, Jr. et al. | 72/58 |

*Primary Examiner*—Lowell A. Larson

*Attorney, Agent, or Firm*—Bachman & LaPointe

[57] ABSTRACT

A process for the production of flanges or collars on hollow parts by lateral extrusion in which the hollow part is supported internally during lateral extrusion, and the support is provided by an elastic and/or plastic medium inserted in the hollow space.

9 Claims, 1 Drawing Sheet

Figure 1:
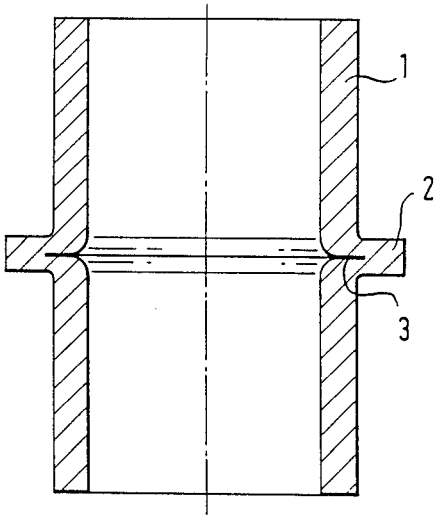

PROCESS FOR THE PRODUCTION OF FLANGES OR COLLARS ON HOLLOW PARTS BY LATERAL EXTRUSION

TECHNICAL FIELD

The invention relates to a process for the production of flanges or collars on hollow parts, which are internally supported during lateral extrusion.

Flanges shaped onto hollow parts have a large number of different uses, e.g. as flanges on tubes, for hubs and the like.

PRIOR ART

For example, lateral extrusion as a forming process is defined in DIN 8583.

Processes and apparatuses are known for the production of pins or journals according to the lateral extrusion process and this also applies regarding the lateral extrusion of a collar on solid bodies. It is also known to extrude gear wheels, radially movable tool elements being used from the outside to the inside. In lateral extrusion, the material flows radially partly from the outside to the centre of the workpiece and partly outwards from the centre of the workpiece.

Solid block forming of solid steel bodies by lateral extrusion of a collar is e.g. described in the journal Draht, 35, 1984, p 13 ff. DE-AS 10 87 433 discloses the internal supporting by means of a punch during the lateral extrusion of hub bodies, particularly for freewheeling brake hubs.

Hitherto the lateral extrusion of flanges or collars of hollow parts was disadvantageous in that a fold or lap always formed in the interior of the hollow part at the flange formation point. It is admittedly known to avoid such a lap by a combination of two-sided can extrusion and lateral extrusion. A hollow part with a collar or flange can also be produced by perforating the can bottom. However, the hollow part length attainable by such a procedure is dependent on the process-based ratio of length to diameter (up to approximately 4), i.e. it has hitherto only been possible in this way to produce hollow parts with process-based maximum length.

DESCRIPTION OF THE INVENTION

The problem of the invention is to provide a process for the production of hollow parts with a flange or collar, which permits the production of flanges or collars without a lap in the flange or collar region and accompanied by low production costs, whilst there is no process-based restriction of the length of the hollow parts provided with flanges.

In a process of the aforementioned type, this problem is solved in that the material is supported in the bore by a plastically acting medium.

Due to the plastic inner supporting of the hollow part during lateral extrusions, there can surprisingly be a deflection of the laterally flowing material towards the outside without the formation of an inner lap or fold and the flange can be produced in a single process stage.

A variable controlled material flow results from the plastic support. Conventionally produced parts with a collar lap, produced by the inexpensive lateral extrusion process, could only be used for less important purposes, because the lap could not be taken into consideration in strength calculations and simultaneously represented a starting point for cracks on applying a load and the fracture of the component. In the preferred embodiment of the inventive process, a plastically and/or elastically deformable material, e.g. rubber, plastic, soft metal or the like is used for support purposes.

According to another preferred embodiment of the inventive process a gas and preferably a gas under high pressure is used for support purposes.

In a particularly preferred embodiment of the inventive process water is used for support purposes and said water has an elastic behaviour under pressures in the range of up to 10,000 bar.

As a result of the inventive process it is possible to produce both rotationally symmetrical and non-rotationally symmetrical flanges or collars.

The supporting effect can partly be obtained by a mandrel, the plastic material only being used in the flange region for balancing and flow reversal purposes. Forming can take place both at ambient temperature and at higher temperatures.

The process can be used on all materials formable by lateral extrusion and can also form part of per se known other forming processes, e.g. can be used together with reducing processes, expanding processes and the like. Steel can be laterally extruded in a particularly preferred manner by the inventive process.

The inventive process makes it possible for the first time to produce flanges or collars on hollow parts without any lap formation in the interior thereof by lateral extrusion and without involving expensive process stages.

A use example is described in greater detail hereinafter relative to the drawings, wherein show:

FIG. 1 A section through a conventional process product.

Figure 2:
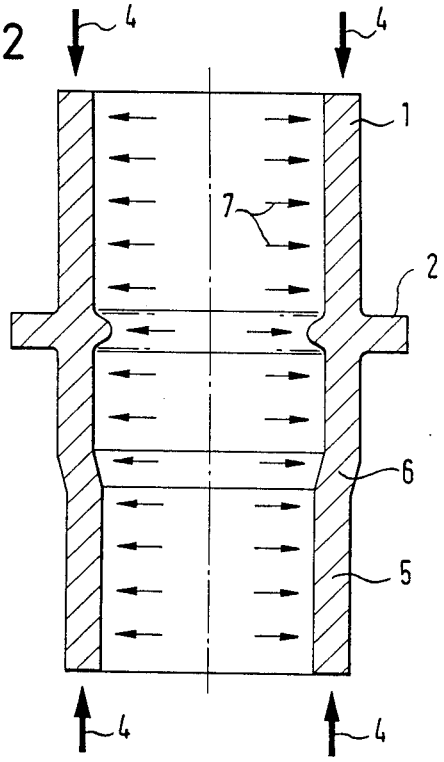

FIG. 2 The application of forces which, in the elastic/ plastic medium, act on the inner walls of the hollow part during lateral extrusion.

FIG. 1 shows a conventional tube with a shaped collar 2 with lap 3. According to the inventive process it can be produced without a lap in the collar region (FIG. 2).

According to a preferred embodiment of the inventive process water is forced under high pressure, i.e. up to 10,000 bar into the cavity during the lateral extrusion of a tube for support purposes. The water provides an elastic support, which constantly adapts to the instantaneous geometrical requirements, which makes it possible to obtain the desired material flow direction during lateral extrusion.

At the end of lateral extrusion the forming and hydraulic pressure is reduced and the finished workpiece can be removed without reworking of the inner flange.

Forming can take place simultaneously with an expansion of the tube during the shaping of a collar. Thus, in FIG. 2, in a forming zone 6, the original tube diameter of hollow part 5 has been expanded to the final diameter of tube 1 in parallel to the forming and accompanied by the production of collar 2.

The inventive features disclosed in the above description, in the drawings and claims can be essential to the realization of the different embodiments of the invention, either singly or in random combination.

I claim:

1. A process for producing a flange or collar on a hollow part having a bore which comprises:

shaping said hollow part to produce said flange or collar using a technique wherein material forming said part flows at least in part radially outwardly from the bore;

internally supporting said hollow part during said shaping so as to substantially prevent the formation of a lap in the region of said flange or collar and so as to be able to substantially constantly adjust to instantaneous geometrical requirements; and said supporting step comprising introducing a medium which produces a relatively high interior pressure and which is at least one of an elastic medium and a plastic medium into the bore.

2. A process according to claim 1 wherein said introducing step comprises introducing a solid medium selected from the group consisting of rubber, plastic and soft metal into the bore.

3. A process according to claim 1 wherein said introducing step comprises introducing under high pressure conditions at least one of a gas and a liquid into the bore.

4. A process according to claim 3 wherein said introducing step comprises introducing water into the bore at a relatively high pressure up to about 10,000 bar.

5. A process according to claim 1 wherein said shaping and internally supporting steps produce a flange or collar which is rotationally symmetrical.

6. A process according to claim 1 wherein said shaping and internally supporting steps produce a flange or collar which is non-rotationally symmetrical.

7. A process according to claim 1 wherein said internally supporting step further comprises introducing a mandrel into said bore during said shaping along with said medium.

8. A process according to claim 1 wherein said shaping takes place at an elevated temperature.

9. A process according to claim 1 wherein said shaping step comprises shaping a hollow part formed from steel.

* * * * *